US007770616B2

(12) United States Patent
Gross et al.

(10) Patent No.: US 7,770,616 B2
(45) Date of Patent: Aug. 10, 2010

(54) DEVICE AND METHOD FOR PROFILING TREE TRUNKS

(75) Inventors: Hermann Gross, Lautenbach (DE); Robert Maier, Biberach (DE)

(73) Assignee: Gebruder Linck GmbH & Co. KG "Gatterlinck" Maschinenfabrik, Oberkirch (DE)

( * ) Notice: Subject to any disclaimer, the term of this patent is extended or adjusted under 35 U.S.C. 154(b) by 556 days.

(21) Appl. No.: 11/577,813

(22) PCT Filed: Oct. 1, 2005

(86) PCT No.: PCT/EP2005/010623

§ 371 (c)(1), (2), (4) Date: Apr. 24, 2007

(87) PCT Pub. No.: WO2006/045403

PCT Pub. Date: May 4, 2006

(65) Prior Publication Data

US 2009/0120532 A1 May 14, 2009

(30) Foreign Application Priority Data

Oct. 25, 2004 (DE) ..... 10 2004 051 933

(51) Int. Cl.
*B27C 9/00* (2006.01)

(52) U.S. Cl. ..... 144/39; 144/378; 144/44

(58) Field of Classification Search ..... 144/1.1, 144/2.1, 3.1, 36–39, 218, 223, 360, 38, 369, 144/359, 378
See application file for complete search history.

(56) References Cited

U.S. PATENT DOCUMENTS

| | | | | |
|---|---|---|---|---|
| 259,661 | A * | 6/1882 | Bowker | 83/102.1 |
| 3,552,457 | A * | 1/1971 | Bos et al. | 144/370 |
| 4,239,069 | A * | 12/1980 | Zimmerman | 144/39 |
| 4,335,767 | A * | 6/1982 | Reuter | 144/370 |
| 4,794,964 | A * | 1/1989 | Wolf | 144/378 |
| 4,846,237 | A * | 7/1989 | Wolf | 144/377 |
| 4,848,427 | A * | 7/1989 | Reuter | 144/369 |
| 4,936,359 | A * | 6/1990 | Totten | 144/3.1 |
| 4,964,448 | A * | 10/1990 | Schultz | 144/223 |
| 5,762,121 | A * | 6/1998 | Rautio | 144/370 |
| 5,983,967 | A * | 11/1999 | Gross et al. | 144/235 |
| 6,240,988 | B1 * | 6/2001 | Wolf | 144/369 |
| 6,637,483 | B2 * | 10/2003 | Stager et al. | 144/373 |
| 2004/0045634 | A1 * | 3/2004 | Stager | 144/223 |

FOREIGN PATENT DOCUMENTS

| | | |
|---|---|---|
| DE | 3702890 | 9/1987 |
| DE | 4419325 | 5/1995 |
| DE | 19960319 | 7/2001 |
| EP | 0744255 | 5/1996 |
| WO | 9533603 | 12/1995 |

* cited by examiner

*Primary Examiner*—Dana Ross
*Assistant Examiner*—Jennifer Chiang
(74) *Attorney, Agent, or Firm*—Volpe and Koenig, P.C.

(57) ABSTRACT

A device for machining, in particular, profiling tree trunks is provided, which includes two rotating machining tools (2, 3), whose axes (A, B) are essentially offset by 90° in relation to one another and are oriented in an essentially perpendicular direction to the longitudinal axis of the tree trunk. The first machining tool (2) and the second machining tool (3) are arranged in relation to one another in such a way that the first axis (A) and the second axis (B) lie on a common plane (E) and/or that their respective workpiece machining zones (I, II) at least partially overlap one another in the transversal direction of the tree trunk or adjoin one another.

19 Claims, 7 Drawing Sheets

DEVICE AND METHOD FOR PROFILING TREE TRUNKS

BACKGROUND

The invention relates to a device and a method for machining, namely profiling tree trunks, comprising a first rotating machining tool which rotates about a first axis and has a first workpiece machining zone, and comprising a second rotating machining tool which rotates about a second axis and has a second machining zone in such a way that the first axis and the second axis are essentially offset by 90° in relation to one another and are oriented in an essentially perpendicular direction to the axis of the tree trunk.

The object of this machining of tree trunks is to cut out a rectangular wood-edged corner area from the tree trunk in order to herewith produce rectangular lateral edges for sideboards to be separated in a later machining step. For this cutting, saw blades are used on the one hand to produce an optimum lateral edge of the sideboard with aid of the saw cut, and, on the other hand, chopping knives to produce shavings with a defined shape which can be resold as a by-product of the tree trunk when cut out of the corner regions of the tree trunk.

The relevant prior art has been dealing with the technology of profiling for decades. Thus, for example, a device of this type for profiling tree trunks is described in DE-A 37 02 890 in which both rotating machining tools consist of combined tool heads which, on the one hand, hold saw-blade elements and, on the other hand, chopping knives.

An almost identical profiling device is known from DE-A 199 60 319 in which, however, the first rotating machining tool does not have any additional chopping knives but only comprises a circular saw blade. As a result, the machining volume machined by the chopping knives of the second machining tool is slightly greater than in the aforementioned device with two rotating chopping knives. However, the disadvantage of a first machining tool consisting of only one circular saw blade is that the split formed by the circular saw blade produces an instability in the machining zone for the second machining tool as the corner area to be cut out by the second machining tool is only connected to the tree trunk on one side, whereas the second side of the corner area is completely separated from the tree trunk by the saw cut. When this corner area which is only supported on one side by means of the chopping knives of the second machining tool is acted upon, due to the lack of support, the corner area tends to vibrate which makes the machining of this corner area with the second machining tool more difficult and clearly affects the result of this operation.

To prevent this spring-tongue-like oscillation, according to the subject matter of DE 199 60 319, this split is supported in the area which has just been sawed clear but not yet acted upon by the chopping knife of the second machining tool with aid of a splitting wedge which is secured on the machining device between the two rotating machining tools. The disadvantage of splitting wedges of this type can easily become stuck due to their thickness corresponding to the width of the saw cut and consequently interrupt the entire production process. If, due to the fact that they got stuck, the splitting wedges are also damaged or due to the fact they wear quickly, the splitting wedges must also be replaced which results in additional costs. If, due to wear, one wishes to delay the replacement of the splitting wedges a little, then this results in so-called endless streaks which are produced due to the fact that the corner area to be cut out by the chopping knife of the second machining tool no longer has adequate support and, as a result, the corner area can yield slightly downward in such a way that the chopping knife cannot remove the entire volume of the corner area to be cut out.

SUMMARY

Based on this, the object of the present invention is now to further improve the known profiling methods with respect to machining expenditure and machining result.

This object is solved with a device of the above-noted type in that the first machining tool and the second machining tool are arranged in relation to one another in such a way that the first axis and the second axis lie in a common plane or cross one another at a slight distance of a few centimeters and that the two workpiece zones at least partially overlap one another in the transverse direction of the tree trunk or adjoin one another.

As a result, the two machining tools, with a very slight offset in time, act essentially upon the same machining section, whereby they at least partially engage with one another or pass by one another. That is, they work intermittently, i.e. at first, e.g. the first machining tool makes a saw cut, optionally combined with a simultaneous cutting of a partial zone adjacent to the saw cut, while the second chopping knife carries out the cutting directly subsequent thereto to produce the shavings.

To the extent that we are speaking of the machining zone of machining tools, then this refers not only to the area in which the workpiece is machined by the tool but the cut amount consisting of the range of action of the tool and workpiece, i.e. the entire area in which the tool crosses through the tree trunk. It can be easily seen that an overlapping or adjoining of the two machining zones in transverse direction of the tree trunk is usually impossible or results in very great difficulties since the two machining tools would either collide hereby or at least considerably interfere with one another.

To avoid this and consequently realize the advantages according to the invention, the first machining tool has a combined milling/saw segment head or a saw segment head in which several saw segments are distributed about its periphery and, optionally, chopping knives parallel thereto are arranged which are sufficiently spaced from one another in peripheral direction to enable an engagement with the second machining tool or to prevent it from being disturbed. Accordingly, the second machining tool is formed from a milling head with several chopping knives distributed about the periphery which are provided to engage in a space between adjacent saw segments each and, optionally, chopping knives of the first machining tool. If the two machining tools are then operated in a synchronized manner in such a way that the workpiece is acted upon intermittently according to the invention, then the collision or disturbance of the tools is prevented in spite of the reciprocal proximity of the tools.

Advantageously, a segmented saw blade is also provided on the milling head in order to also neatly produce the second edge of the corner zone to be cut out with a saw cut.

To the extent that we are speaking of a meshing of the two machining tools in the present case, then it is pointed out that this meshing has, of course, nothing to do with the meshing of cogwheels which must come into contact during meshing for the transmission of the driving movement; rather, the two machining tools should not come into contact to enable a problem-free machining of the corner area of the tree trunk. On the contrary, the term "meshing" should express that the two machining tools alternately act upon or penetrate almost the same machining zone.

And, to the extent that we are speaking here of a common machining zone or of almost identical machining zones, this is understood to mean that the chopping knives of the second machining tool have to sink, by necessity, into an area which has been previously cut free by the saw segments; in the (theoretical) ideal case, the machining zones of the two machining tools may also adjoin one another without overlapping or penetrating one another. However, it is essential that a reciprocal disturbance or contact or influence of the two machining tools be excluded.

To illustrate the fact that the two machining tools also machine the tree trunk successively in the prior art in such a way that the machining on the whole took place on the end of the tree trunk in overlapping or adjoining areas without, however, the machining zones penetrating one another or overlapping in transverse direction during the machining of the tree trunk, we are here, in addition, speaking of "longitudinal section of machining" if the intermittent machining according to the invention by the two tools in the same longitudinal section of the machining device is to be described. A "longitudinal machining section of a machining device" thereby means that the machining takes place with a tool in a specific longitudinal area relative to the longitudinal axis or longitudinal direction of a machining device (which usually corresponds to the longitudinal axis or longitudinal direction of the adjacent machining devices or the entire associated profiling facility).

Accordingly, if the two workpiece machining zones are situated at least essentially on the same longitudinal machining section of the machining device, then the associated tools are machining the tree trunk intermittently so that they penetrate the two workpiece machining zones, i.e. overlap in transverse direction of the tree trunk or that they at least adjoin one another.

According to the invention, the first machining tool and the second machining tool are arranged in relation to one another in such a way that the first axis and the second axis lie in a common plane or cross one another by a few centimeters. In this case, it is especially advantageous if the common plane of the two axes is oriented essentially at a right angle to the axis of the tree trunk. As a result, the two machining tools actually have no or almost no offset vis-à-vis one another in longitudinal direction of the tree trunk, i.e. they are machining the tree trunk parallel to one another, i.e. almost simultaneously (the individual segments of the machining tools alternate with one another in immediate succession during the machining) in the same longitudinal machining section.

It can be easily seen that this merging of the two machining zones in a common longitudinal machining section results therein that the split formed by the first machining tool in longitudinal direction of the trunk is now only very short since the exposed corner area is acted upon immediately thereafter by the second machining tool. Consequently, this corner area in the area of the split also no longer has to be supported, so that one can manage without difficulty without the use of splitting wedges. While the split area exposed by the first saw cut (the so-called preslit split) in the prior art is in the magnitude of about half a meter (approximately corresponding to the distance of the two machining tools), the split length in the device according to the invention is only a few centimeters, this length being dependent on the range of action of the machining tools, on the width of the first machining tool and on the finished dimensions. By a suitable selection of the width of the first machining tool, a split and with it the disadvantageous spring tongue can even be completely avoided.

A special advantage of the distance between the machining zone of the first machining tool and the machining zone of the second machining tool, which is reduced up to 0 in longitudinal direction of the trunk, is that the formal defects are minimized in an arc section; since to date, when attempting to saw in a curve-conforming manner to adapt to the curvature of a tree trunk, the machining zones of the two machining tools, spaced from one another, had to result in a width adjustment of the two machining tools independent of one another to compensate the differences in curvature in the two machining zones, a compensation of this type is no longer required in the merging of the two machining zones according to the invention since both machining tools can be adjusted simultaneously or jointly.

It is especially advantageous if the two machining tools are mounted together in an angle-cutting unit, so that they can be advantageously activated via the same drive and, in particular, via a common drive unit and can be jointly adjusted with respect to their orientation relative to the tree trunk and/or further machining tools. In this case, for example, the entire angle cutter or milling/saw unit can be turned about a horizontal axis (in association with a servocontrol height axis) in order to edge a sideboard extending diagonally to the bench support of the tree trunk up and down along the wood to be machined. With an adjustability of this type, described as path control, a clear yield gain of the side product results compared to a previously conventional bench-parallel edging. Moreover, as a result, it is possible that the run of the cut of the side product is more likely to extend parallel to the grain.

A further common adjustment of the milling/saw unit can be used, by turning about a vertical axis, to make a cut that follows the curvature without a backward cut, without the necessity of making an additional adjustment in width of the two machining tools relative to one another.

The present invention not only proposes a device for machining, namely profiling tree trunks, but also a method for the machining, namely profiling of tree trunks. For example, a profiling method known from DE-A 199 60 319 consists of making a saw cut in the tree trunk extending essentially parallel to the axis of the tree trunk and of the subsequent cutting of, in particular, wood-edged corner area which is limited at least essentially by the saw cut. The distances described above in association with the aforementioned document are also to be avoided with the profiling method according to the invention and should also improve machining expenditure and machining result accordingly. This is attained according to the invention in that the saw cut and the cutting take place parallel to one another, at least partially in the same machining section and/or intermittently.

As a result, the advantages already noted above in connection with the profiling device are obtained. Advantageously, in this case also, the making of the saw cut and subsequent cutting take place with segmented machining tools which engage in one another or run past one another, whereby the two machining tools are advantageously actuated jointly.

The two machining tools act alternately upon the same machining zone or at least directly adjoining machining zones, however, which lie in the same (longitudinal) machining section. By means of this common machining zone or the directly adjoining machining zones, the saw cut and the cutting can be adapted to the shape of the tree trunk in that the two machining tools are turned together about a common horizontal and/or vertical swivel axis and/or are jointly adjusted along a common horizontal and/or vertical axis.

In contrast to the aforementioned DE-A 199 60 319, the special advantage is that a split is formed by the saw cut (optionally combined with adjacent cutting) and the respectively subsequent intermittent cutting, said split having a maximum length in the magnitude of a few centimeters in longitudinal direction of the tree trunk. As a result, the split no longer has to be supported by a splitting wedge.

BRIEF DESCRIPTION OF THE DRAWINGS

Further features and advantages of the present invention can be found in the following description of an embodiment with reference to the drawings, showing.

DETAILED DESCRIPTION OF THE PREFERRED EMBODIMENTS

Figure 1:
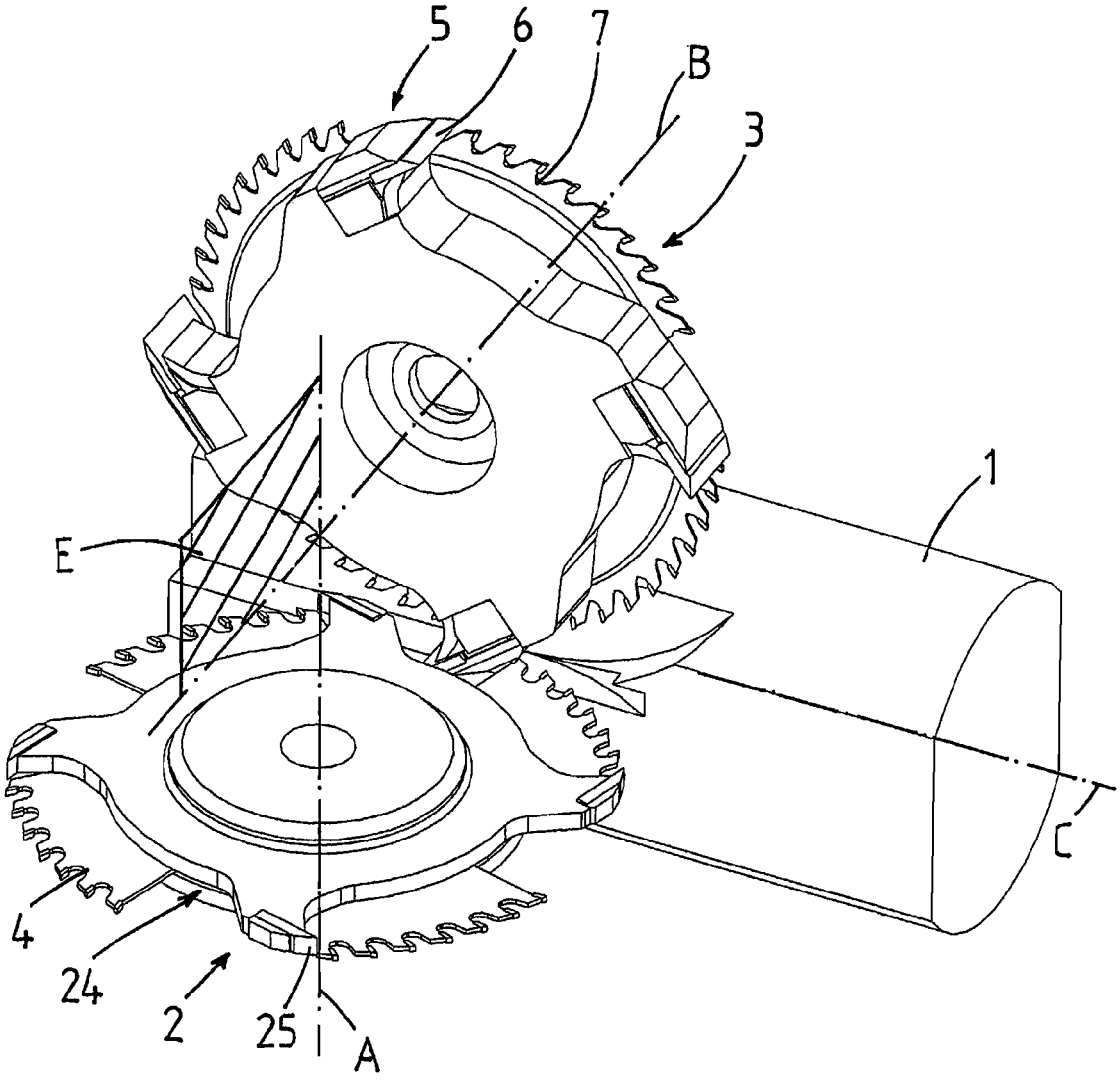
FIG. 1 a machining device according to the invention in a schematic perspective view from the front.

FIG. 1 shows a section of a tree trunk, a so-called model 1, which is acted upon by a first machining tool 2 and a second machining tool 3 to work out a corner area 1*a* (see FIG. 3*a*) of the tree trunk. In this case, the first machining tool 2 consists of a saw segment head having four saw segments 4 distributed about its periphery and a milling head 24 arranged adjacent thereto with four chopping knives 25 distributed over its periphery. Each saw segment 4 or chopping knife 25 has a greater distance in peripheral direction in relation to the respectively adjacent saw segment 4 or chopping knife 25, as will be explained in greater detail in the following in association with the second machining tool 3. The first machining tool 2 has a first axis of rotation A which is oriented essentially at a right angle to the longitudinal axis C of the tree trunk 1 and extends in vertical direction in the embodiment of FIG. 1.

The second machining tool 3 has a milling head 5 with a total of four chopping knives 6 distributed over the periphery which, similar to the saw segments 4 of the machining tool 2, are reciprocally spaced over the periphery in such a way that they can immerse into the space between the adjacent saw segments without the two machining tools coming into contact. Adjacent to the milling head 5, additional saw segments 7 are provided (with recesses in the area of the chopping knives 6) which also make a saw cut on the side edge of the model or corner area machined by the second machining tool 3. The second machining tool 3 turns about an axis of rotation B which, as the first axis A, is oriented essentially at a right angle to the longitudinal axis of the tree trunk and extends in horizontal direction in the embodiment of FIG. 1.

According to the invention, the two axes of rotation A and B are not only arranged offset to one another by 90°, but they also still lie in essentially the same plane E, so that the machining tool 2 with its machining zone I and the machining tool 3 with its machining zone II alternately or intermittently act upon the model in the same longitudinal machining section III, i.e. in the same longitudinal area of the tree trunk (in this connection, see FIGS. 3*e* to 3*h* as well as 5*b*).

Figure 2:
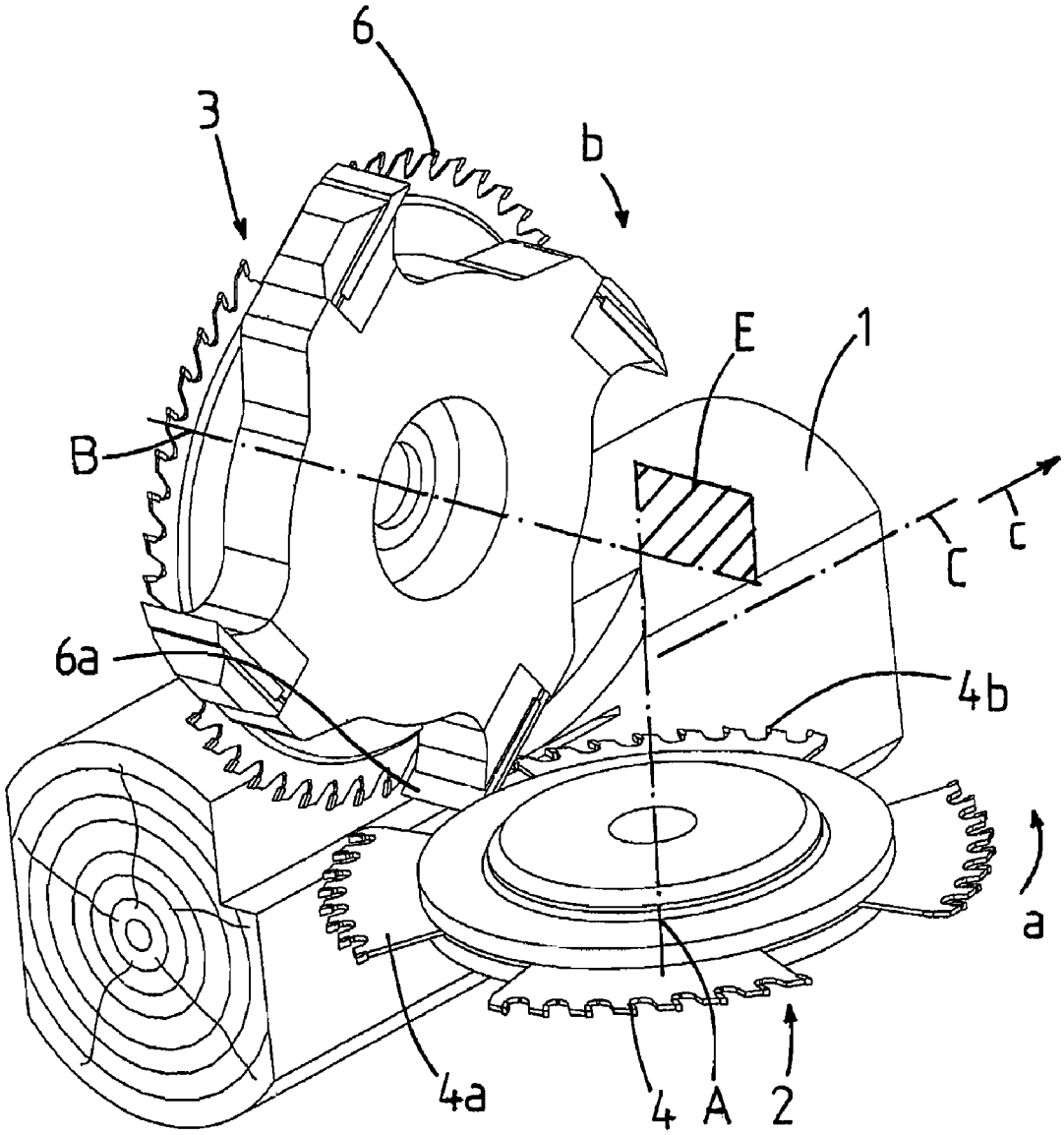
FIG. 2 an alternative machining device according to the invention in a schematic perspective view, from the back.

FIG. 2 now shows a similar device and arrangement from the rear, i.e. in line of sight against the feed direction c. The only difference is in that the machining tool 2 in this embodiment consists of only one saw segment head (omitting the milling head 24 of FIG. 1). All other components are identical to the embodiment of FIG. 1, which is why they are also identified by the same reference signs. In FIG. 2, the directions of rotation A and B of the two machining tools 2 and/or 3 are also indicated. In this view, it can be clearly seen how the saw segment 4*a* has just left the machining section in the area of model 1 and that the knife head 6*a* now acts upon this machining section, before the further saw segment 4*b* (after the knife head 6*a* has been removed from the machining section) acts upon this machining section as the next machining tool. Above all, essential to the invention is the fact that the two machining tools are arranged on the same longitudinal position relative to the direction of conveyance c of the entire machining device and there act upon the respective tree trunk.

Figure 3:
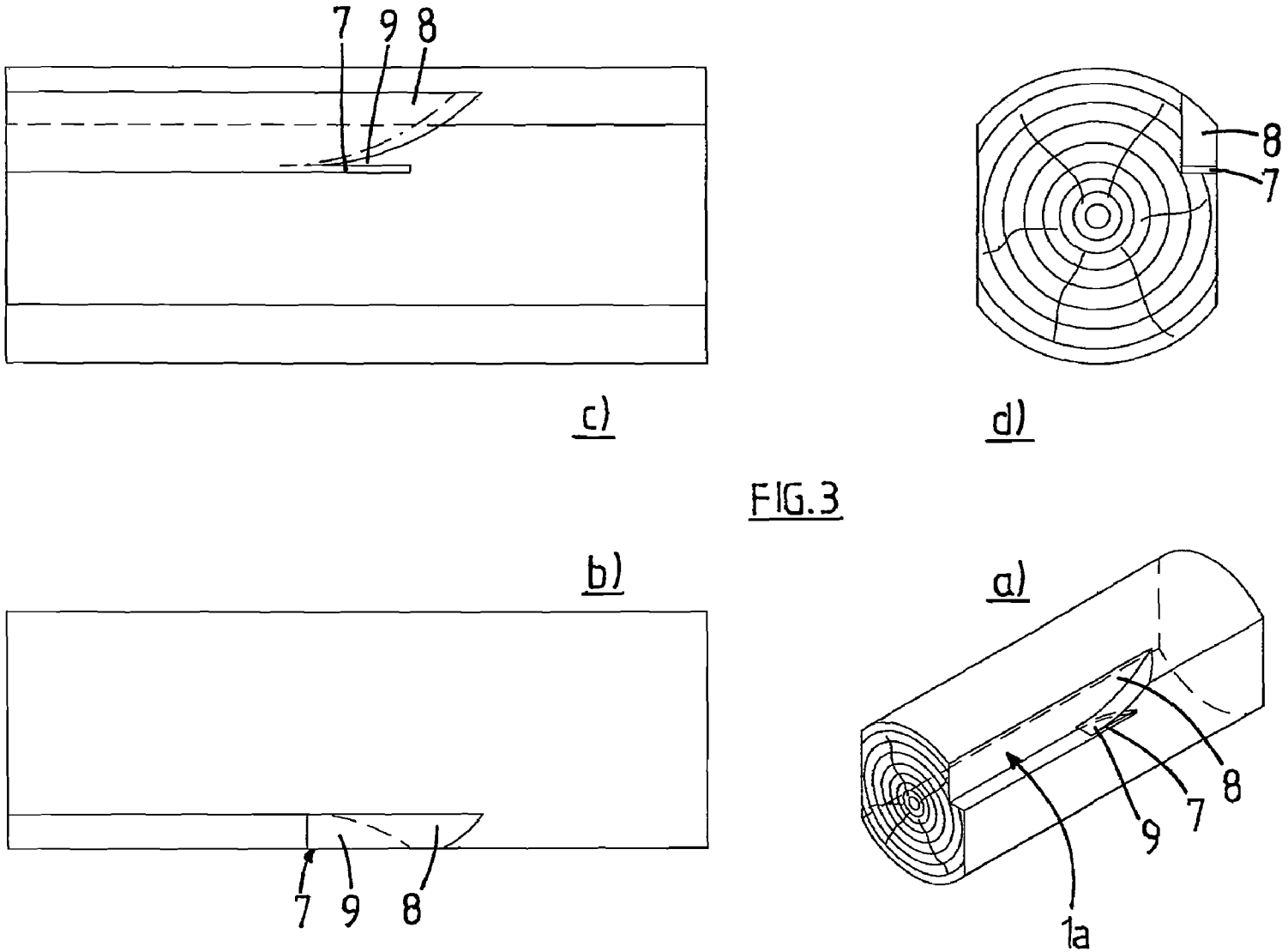
FIGS. 3*a* to *d* are various views of a tree trunk partially worked as per FIG. 2 by the machining device according to the invention.
FIGS. 3*e* to *h* are various views of a tree trunk partially worked as per FIG. 1 by the machining device according to the invention.
Figure 3:
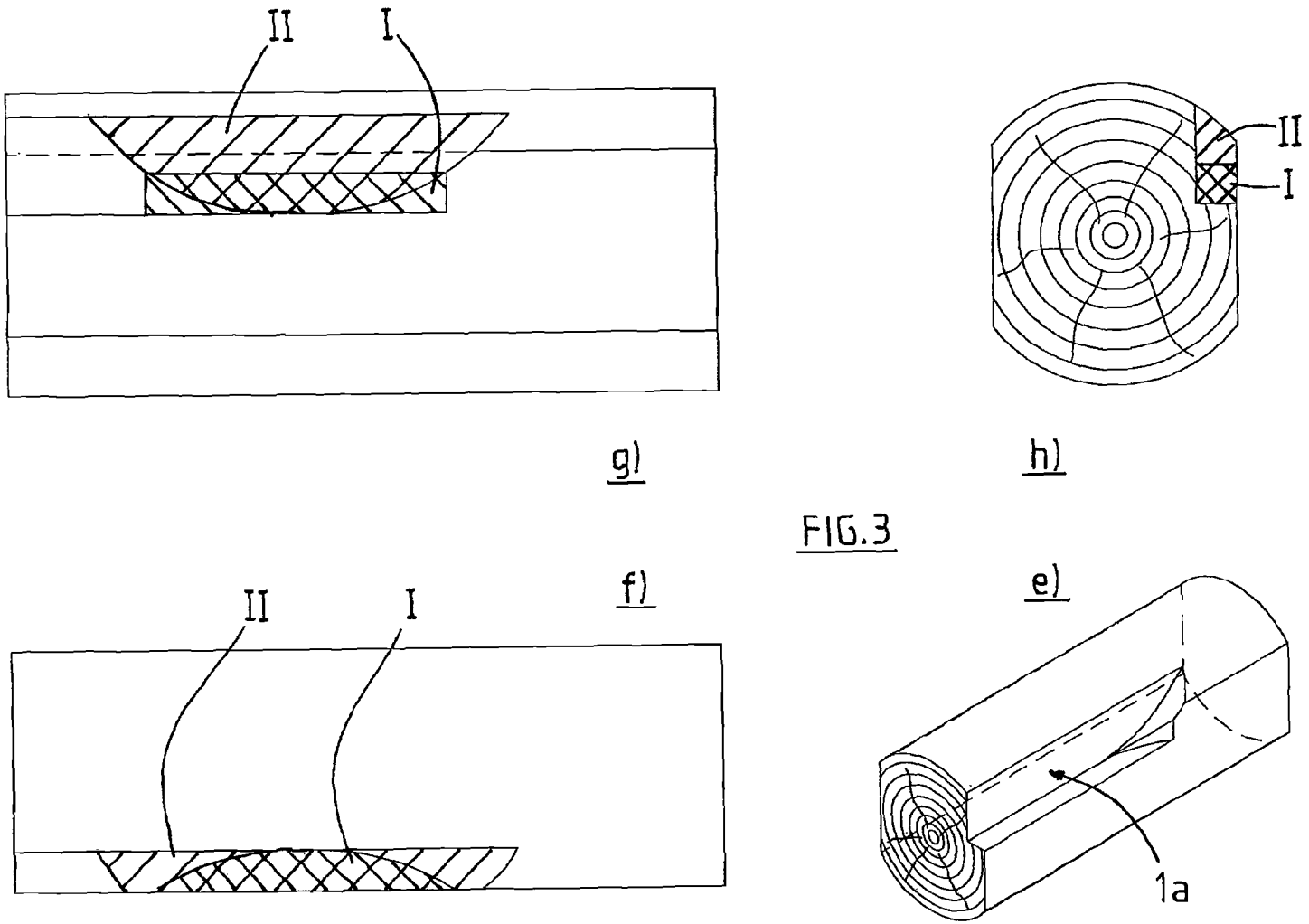

FIGS. 3*a* to 3*d* show a partially machined model of the device of FIG. 2 in a perspective side view (FIG. 3*a*), in a top view (FIG. 3*b*), in a side view (FIG. 3*c*) and in a rear view (FIG. 3*d*). A very short emergent split 7 can be very clearly seen here which consists of a saw cut made by the saw segments 4 and extending in longitudinal direction of the tree trunk, said saw cut being limited in longitudinal direction by a milling 8 produced by the milling head 5. As can be seen especially in the top view in FIG. 3*b*, the size of the spring tongue 9 covering the split 7 is minimal, so that it is adequately supported by the remaining model area and no separate splitting wedge is required for its support.

On the other hand, FIGS. 3*e* to 3*h* show a partially machined model of the device of FIG. 1 in a perspective side view (FIG. 3*e*), in a top view (FIG. 3*f*), in a side view (FIG. 3*g*) and in a rear view (FIG. 3*h*). In this case, a machining zone I of the first machining tool 2 (not shown) and a machining zone II of the second machining tool 3 (also not shown), respectively, is shown in FIGS. 3*f* to 3*h*. The machining zones are those areas upon which the associated machining tools act at a specific time in the tree trunk. Since both machining zones overlap in all three views (can be seen with reference to the overlapping of the two shaded parts of the drawings), it is obvious that the associated manufacturing tools also engage and must work intermittently, as they would otherwise collide with one another. It can also be seen in these figures that the machining zone I is so thick that there is no split at all which would correspond to the split 7 shown in FIGS. 3*a* to 3*d*. Consequently, the disadvantageous spring tongue is also missing which must be expressly supported in the prior art by a splitting wedge.

Figure 4:
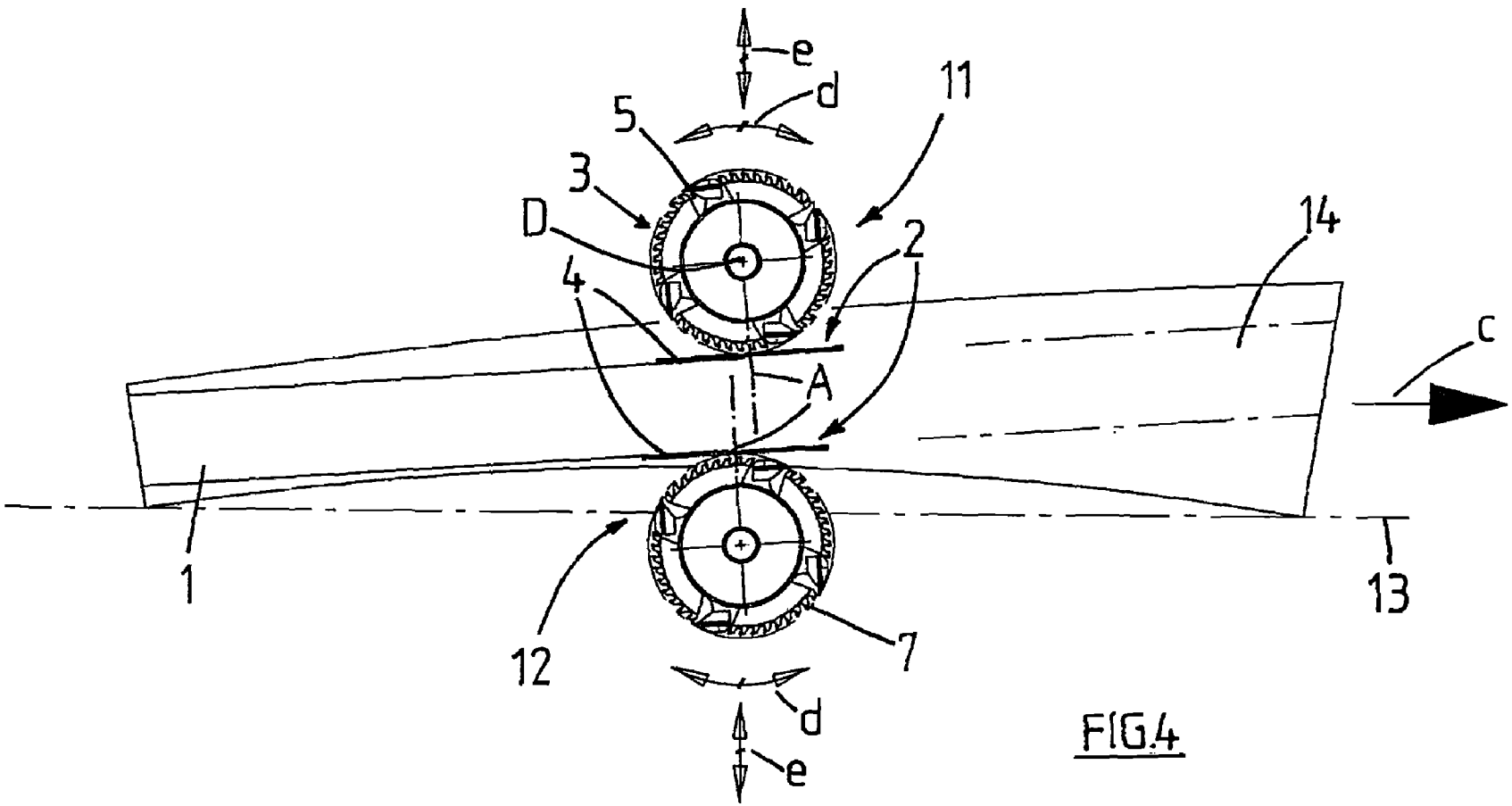
FIG. 4 the machining device according to the invention from FIG. 2 in a schematic side view to illustrate the path control, and FIG. 5 the machining device according to the invention from FIG. 2 in a schematic top view to illustrate the principle of curve-conforming cutting, in FIG. 5*a* in a side product and in FIG. 5*b* in two side products.

The principle of the path control made possible by merging the two machining tools according to the invention is now schematically illustrated in FIG. 4. The model 1 is shown there in a side view as well as two machining devices 11, 12 with a first machining tool 2 and a second machining tool 3 each. whereby each machining device is designed mirror-inverted but otherwise in the same way and each have a saw segment head 4 and a milling head 5 with attached saw blade 7. In comparison to the bench support 13 horizontally shown in FIG. 4, the machining planes of the saw segment heads 4 are inclined, so that a sideboard 14 extending diagonally to the bench support 13 can be edged upward along the wood model to be machined. Accordingly, the axes A of the saw segment heads 4 are somewhat inclined in relation to the vertical in that the machining devices 11, 12 have been turned about a horizontal swivel axis D in direction d. To adapt the contact point to this inclination, each machining device 11, 12 can be adjusted in elevation e and the mutual distance changed in this way.

In this inclined arrangement of the machining device 11 or 12 consisting of saw segment head 4 and milling head 5 also, the axes of the saw segment head, on the one hand, the milling head, on the other hand, are at a right angle to one another and lie in a common plane, whereby, however, the resultant plane of the machining device 11 is arranged only parallel to the corresponding plane of the machining device 12 in the embodiment of FIG. 4, however, due to the aforementioned inclination of the two machining devices, does not coincide with this plane.

Figure 5A:
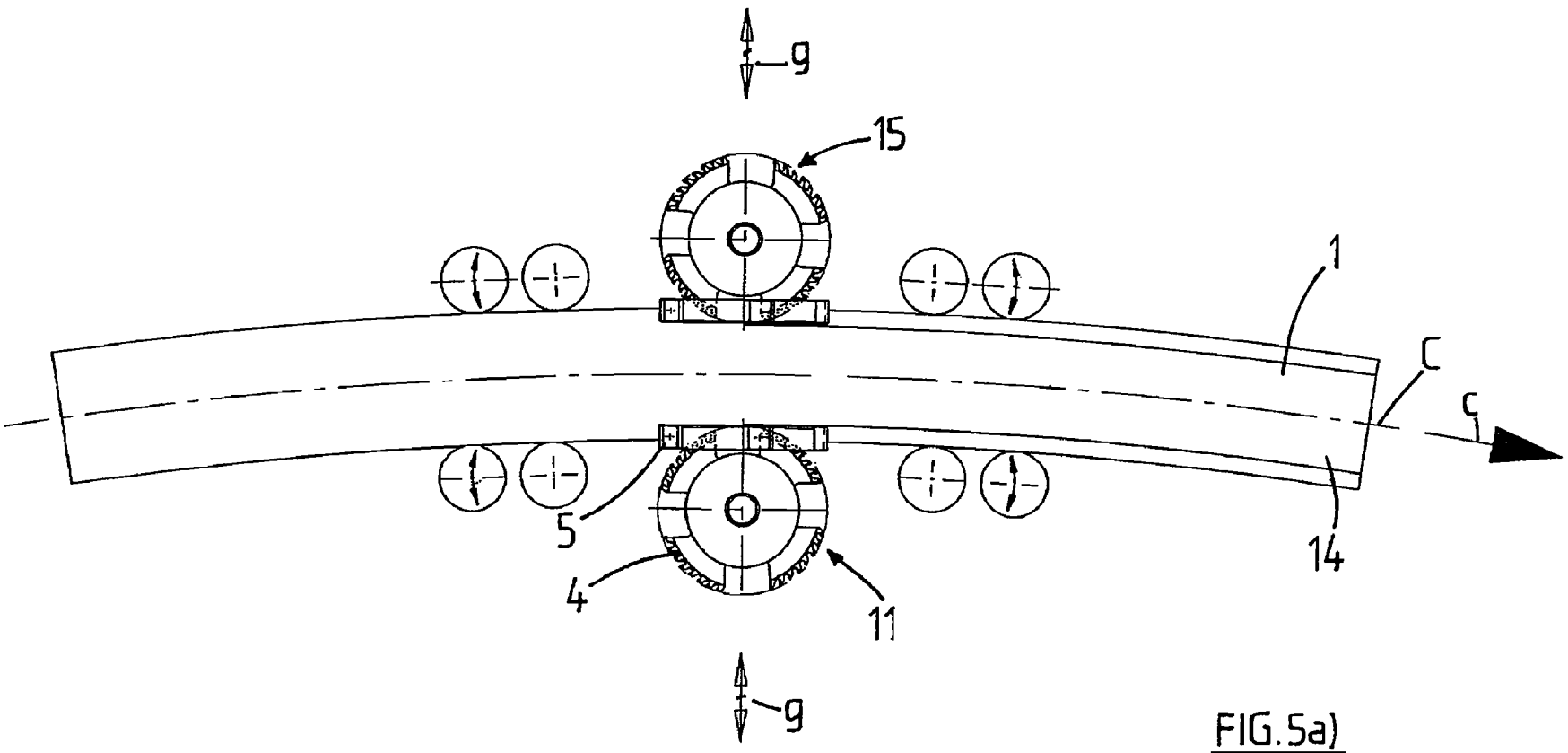
Figure 5B:
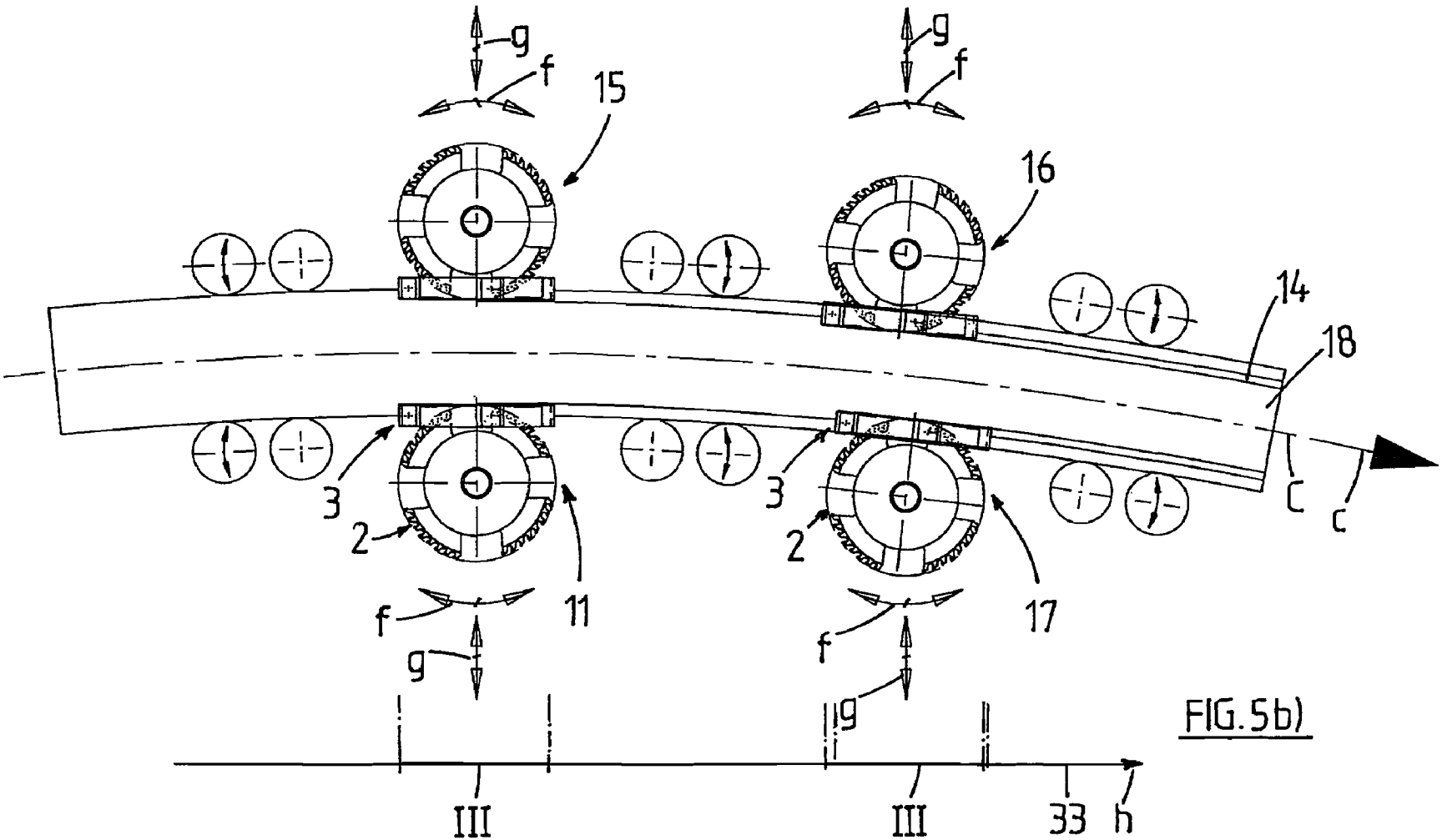

In FIG. 5*a*, on the one hand, the machining device 11 and, on the other hand, a machining device 15 constructed in the same manner is shown in a top view. A curve-conforming cut is made in the model in this case to produce a side product without a backward cut. As can be seen in FIG. 5*b*, which shows two additional similarly constructed machining devices 16, 17, the left and right machining devices can be turned in pairs about their vertical axis in direction of the arrow f in order to perform an active curve cutting as a result by inserting two side products 14, 18, i.e. not only to adjust the machining devices in a lateral sense g (as shown in FIG. 5*a*) but also, in addition, to turn them about the vertical axis.

In FIG. 5*b*, a common longitudinal direction h of the four machining devices 11, 15, 16 and 17 is also shown which are part of a profiling installation. The associated longitudinal machining sections III are shown for the machining tools 2 and 3 of the machining devices 11 and 17 along an axis 33 extending in longitudinal direction h, whereby the machining tools 2 and 3—and with them the associated workpiece machining zones (I, II) (not shown)—of a machining device are situated respectively on the same longitudinal machining section III.

In summary, the present invention offers the advantage in almost any orientation desired of the two tool axes (i.e. the axis of the first machining tool can be arranged both vertically and horizontally oriented or inclined to the horizontal or to the vertical, whereby the axis of the second machining tool lies in the same plane hereto always offset by 90°) of providing a compact and quick-built machining device by combining the two machining tools in a unit acting upon the same longitudinal machining section, it being possible to simply and easily insert it in existing machining lines due to their slight length.

Moreover, the device or the method according to the invention make a splitting wedge superfluous, so that all risks of jamming associated therewith or the expense of replacing tools are omitted. As a result, the comparatively thick split require for a splitting wedge can also be smaller which, in turn, leads to a yield gain due to the increase of the shaving portion to be cut and also leads to a reduction of the required generated power or machining performance due to the comparatively smaller crushing operation in the area not to be cut.

In addition, by attaching both machining tools to a common drive unit, the danger is eliminated that both tools are running, i.e. are shifted in relation to one another. And finally, due to the joint mounting on a drive unit, an optimal adjustability of the tools along the wood is also provided which can, for example, be used for a path control or for a curve-conforming cutting path.

The invention claimed is:

1. A device for profiling tree trunks, comprising a first rotating machining tool (2) which turns about a first axis (A) and has a first workpiece machining zone (I), a second rotating machining tool (3) which turns about a second axis (B) and has a second machining zone (II), whereby the first axis (A) and the second axis (B) offset by about 90° to one another and are each oriented at a right angle to a longitudinal axis (C) of the tree trunk (1), the first machining tool (2) and the second machining tool (3) are disposed in relation to one another in such a way that the first axis (A) and the second axis (B) lie in a common plane (E) or cross one another at a slight distance of up to a few centimeters, and the two respective workpiece machining zones (I, II) at least partially overlap one another in a transverse direction of the tree trunk or adjoin one another.

2. The device according to at least claim 1, wherein the two workpiece machining zones (I, II) are each located at least partially within a same longitudinal machining section (III) of the machining device (11, 12, 15, 16, 17).

3. The device according to at least claim 1, wherein the common plane (E) of the two axes (A, B) of the machining tools (2, 3) are oriented generally at a right angle to the axis (C) of the tree trunk.

4. The device according to at least claim 2, wherein the two machining tools (2, 3) alternately act upon the same longitudinal machining section (III).

5. The device according to claim 1, wherein the two machining tools (2, 3) mesh at least partially with one another.

6. The device according to claim 1, wherein the first machining tool (2) has a saw segment head.

7. The device according to at least claim 6, wherein the first machining tool (2) has an additional milling head (24) with several chopping knives (25) distributed over a periphery thereof.

8. The device according to at least claim 6, wherein the saw segment head (2) has several saw segments (4) distributed over a periphery thereof and adjacent ones of the saw segments are sufficiently spaced from one another in a peripheral direction to enable a meshing and/or running past one another with the second machining tool (3).

9. The device according to claim 1, wherein the second machining tool (3) is comprised of a milling head (5) with several chopping knives (6) distributed over a periphery thereof.

10. The device according to claim 9, wherein that the chopping knives (6) are provided to each engage in a space between adjacent saw segments (4) of the saw segment head (2).

11. The device according to claim 9, wherein in that the milling head (5) also has a specially segmented saw blade (7).

12. The device according to claim 1, wherein the two machining tools (2, 3) are mounted together in an angle milling unit.

13. The device according to claim 1, wherein the two machining tools (2, 3) are adjusted jointly with respect to their orientation relative to the tree trunk (1) and/or further machining tools (12, 15, 16, 17).

14. A method for profiling tree trunks, comprising:

providing a device for profiling tree trunks, including a first rotating machining tool (2) which turns about a first axis (A) and has a first workpiece machining zone (I), a second rotating machining tool (3) which turns about a second axis (B) and has a second machining zone (II), whereby the first axis (A) and the second axis (B) are offset by about 90° to one another and are each oriented at a right angle to a longitudinal axis (C) of the tree trunk (1), the first machining tool (2) and the second machining tool (3) are disposed in relation to one another in such a way that the first axis (A) and the second axis (B) lie in a common plane (E) or cross one another at a slight distance of up to a few centimeters, and the two respective workpiece machining zones (I, II) at least partially overlap one another in a transverse direction of the tree trunk or adjoin one another;

at least making a saw cut in a tree trunk (1) with the first rotating machine tool, said saw cut extending generally parallel to the longitudinal axis (C) of the tree trunk, cutting at least a second cut with the second rotating machining tool offset by about 90° to the saw cut to define a wood-edged corner area (1*a*) limited at least generally by the saw cut, and the making of the saw cut and the cutting of the second cut take place parallel to one another at least partially in a same longitudinal machining section (III).

15. The method according to at least claim 14, wherein the machining tools comprise segmented engaging machining tools (2, 3) and/or machining tools (2, 3) which run past one another.

16. The method according to at least claim 15, wherein the two machining tools (2, 3) act intermittently upon the same longitudinal machining section (III) with overlapping machining zones (I, II) or at least directly adjacent machining zones (I, II).

17. The method according to at least claim 15, wherein the two machining tools are adjusted to one another such that no split is formed when the saw cut is made and the subsequent cutting of the second cut or, at best, a split (7) which has a maximum length of a few centimeters in a longitudinal direction (c) of the tree trunk.

18. The method according to at least claim 15, wherein the first machining tool is a combined saw segment/milling head and simultaneously makes the saw cut and cuts out an adjacent area of the tree trunk.

19. The method according to at least claim 15, wherein the saw cut and the cutting of the second cut are adapted to the shape of the tree trunk (1) in that both of the machining tools (2, 3) are turned together about a common horizontal and/or vertical swivel axis (D, F) and/or adjusted along a common horizontal and/or vertical axis (e), (g).

* * * * *